US005249930A

United States Patent [19]

Pacquesi

[11] Patent Number: 5,249,930

[45] Date of Patent: Oct. 5, 1993

[54] SUMP PUMP STRAINER AND PLATFORM ASSEMBLY

[76] Inventor: John J. Pacquesi, 2017 Second St., Highland Park, Ill. 60035

[21] Appl. No.: 960,244

[22] Filed: Oct. 13, 1992

Related U.S. Application Data

[63] Continuation-in-part of Ser. No. 871,138, Apr. 20, 1992.

[51] Int. Cl.[5] ..... F04B 23/00

[52] U.S. Cl. ..... 417/313; 417/423.3; 417/423.9

[58] Field of Search ..... 417/12, 36, 40, 423.3, 417/423.9, 423.14, 572, 313; 415/121.2

[56] References Cited

U.S. PATENT DOCUMENTS

| | | | |
|---|---|---|---|
| 2,242,278 | 5/1941 | Yonkers, Jr. | 415/121.2 |
| 2,295,982 | 9/1942 | Widman | 415/121.2 |
| 3,264,999 | 8/1966 | Tutthill | 417/423.3 |
| 3,310,242 | 3/1967 | Perkins et al. | 415/121.2 |
| 4,080,104 | 3/1978 | Brown, Jr. | 417/40 |

FOREIGN PATENT DOCUMENTS

| | | | |
|---|---|---|---|
| 32299 | 2/1987 | Japan | 415/121.2 |
| 73370 | 1/1931 | Netherlands | 417/423.9 |
| 1454270 | 11/1976 | United Kingdom | 417/423.14 |

*Primary Examiner*—Richard A. Bertsch
*Assistant Examiner*—Roland G. McAndrews
*Attorney, Agent, or Firm*—Dressler, Goldsmith, Shore, Sutker & Milnamow, Ltd.

[57] ABSTRACT

A novel sump pump strainer assembly consisting of a basket having elongated circumferentially spaced openings disposed in a sump pit and having a sump pump located thereon. The basket is provided with a screen around its lower portion to prevent the introduction of debris into the basket that could clog the inlet of the pump. A shield on the basket is located opposite any inlet into the sump pit above the screen to prevent debris from entering the basket above the screened portion. In another embodiment, the pump is disposed on a specially designed platform that assists in directing debris away from the inlet of the pump. This platform can include a strainer attached thereto if desired.

4 Claims, 2 Drawing Sheets 46
40
42
47
44
49
50
48
22
30
34
14
28
24
26
18
12
60

SUMP PUMP STRAINER AND PLATFORM ASSEMBLY

This application is a continuation-in-part of application Ser. No. 07/871,138, filed Apr. 20, 1992.

FIELD OF THE INVENTION

This invention relates to a sump pump assembly which is located in a sump pit and is positioned to receive drain water through drain tiles located around a residence or other establishment. It is particularly directed to such an assembly that is designed to prevent clogging of the sump pump used to evacuate the drain water, which clogging problem is inherent in existing systems.

BACKGROUND OF THE INVENTION

It has been conventional to use strainer assemblies located in a sump pit into which drain water and other residue, such as mud, leaves, rocks, etc., are introduced along with drain water. A typical type of an arrangement that is used is a basket which is provided with elongated circumferentially spaced openings to allow the water to flow therethrough while preventing the introduction of large objects from contacting the pump inlet. Such arrangements are unsatisfactory if along with the rain water there are small particles of varying kinds of residues that are small enough to go through the openings of the strainer constructions. Such materials can find their way into the inlet of the pump and clog the same, thus requiring that the pump be cleaned very frequently, or under severe conditions require that the pump be periodically replaced.

SUMMARY OF THE INVENTION

In accordance with the present invention, there are provided several novel embodiments of assemblies to prevent mud, leaves, and other debris from clogging up the intake of a sump pump. In one arrangement, there is employed a strainer basket assembly to prevent introduction of particulates, such as mud, leaves, rocks, and so forth, into the interior of a basket area in which the sump pump is located.

The sump pump pumps the drain water out through a discharge pipe secured thereto. The strainer basket is provided at its lower portion with a screen having relatively small openings which will effectively preclude the introduction of the aforementioned foreign materials. By preventing these materials from being introduced into the strainer basket they will not be conveyed to the inlet of the pump, thus clogging the pump and making cleaning and/or replacement of the pump necessary. In the event the screen becomes clogged, the strainer basket can be readily removed, cleaned, and replaced without damage thereto.

In another embodiment, there is provided a strainer platform on which the sump pump is located, which platform supports the sump pump in an elevated area and permits rocks and debris to be collected in an area beneath the sump pump and then directed away from the sump into the bottom of the sump pit. The platform can be used within a strainer basket assembly or it can be used separate or apart from a strainer basket, in which event it would include a strainer portion disposed thereabove to help to further minimize the introduction of mud, rocks, leaves, and so forth, into the area adjoining the inlet of the sump pump.

BRIEF DESCRIPTION OF THE DRAWINGS

The invention can best be understood when considered in conjunction with the accompanying drawing, in which.

DETAILED DESCRIPTION

Figure 1:
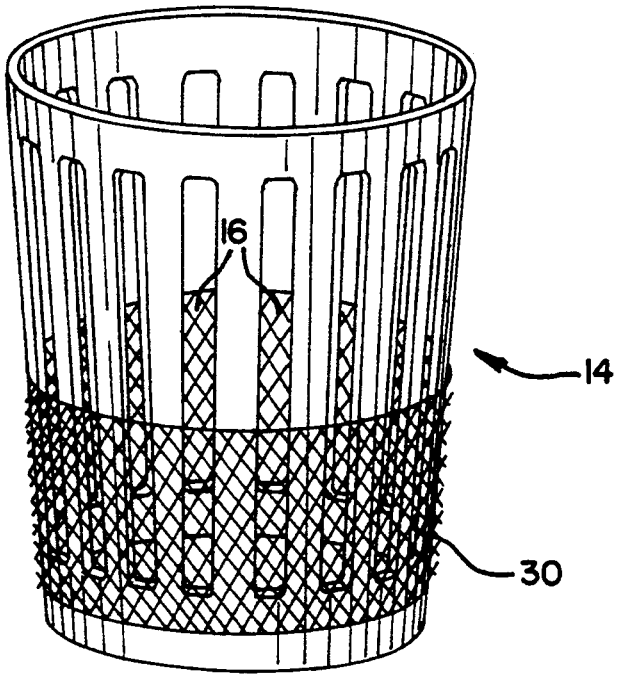
FIG. 1 is a perspective view of the strainer basket assembly.
Figure 2:
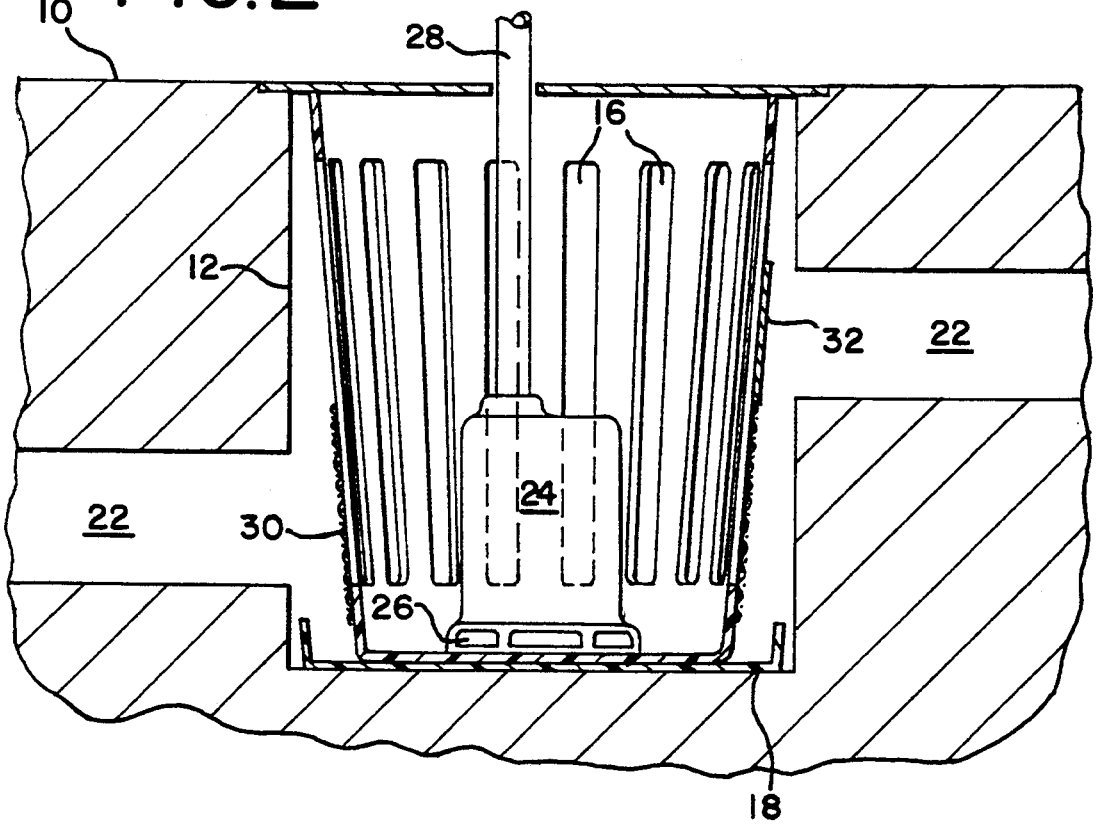
FIG. 2 is a view showing the strainer basket located in place in a sump pit and having located therein a sump pump.

While the present invention embodies various forms, there are shown in the drawings that will hereinafter be described a presently preferred embodiment, with the understanding that the present disclosure is to be considered as an exemplification of the invention and is not intended to limit the invention to the specific embodiment illustrated.

Referring now to the drawings, there is shown a sump pit located below the ground level 10. The sump pit 12 has disposed therein the novel strainer basket assembly 14 which is provided with elongated openings 16 through which the drain water flows into the interior thereof. The strainer basket is located on a catch tray 18 within the sump pit 12. Leading into the sump pit are drain tiles 20,22 through which the drain water and associated mud, leaves, rocks, etc. flow.

Located within the strainer basket 14 is the pump 24 having inlet 26 and a pump discharge pipe outlet 28. Thus, water received from the drain tile through the strainer basket will be pumped out of the sump pit by the pump 24 through the discharge pipe 28.

In accordance with one embodiment of the present invention, the strainer basket is provided around its lower portion with a screen 30 to prevent the introduction of mud, leaves, rocks, etc., into the interior of the strain basket, which could cause clogging of the pump and ultimate replacement thereof, or at the very least result in a decreased efficiency in its operation.

In addition, in the case of drain tile 22, through which water and associated debris can flow into the sump pit above the level of the strainer, there is provided a clip-on shield 32 that directs the water and associated debris downwardly into the bottom of the sump pit 12. The sump pit is covered by the cover 34.

Figures 3, 4, 5, 6:
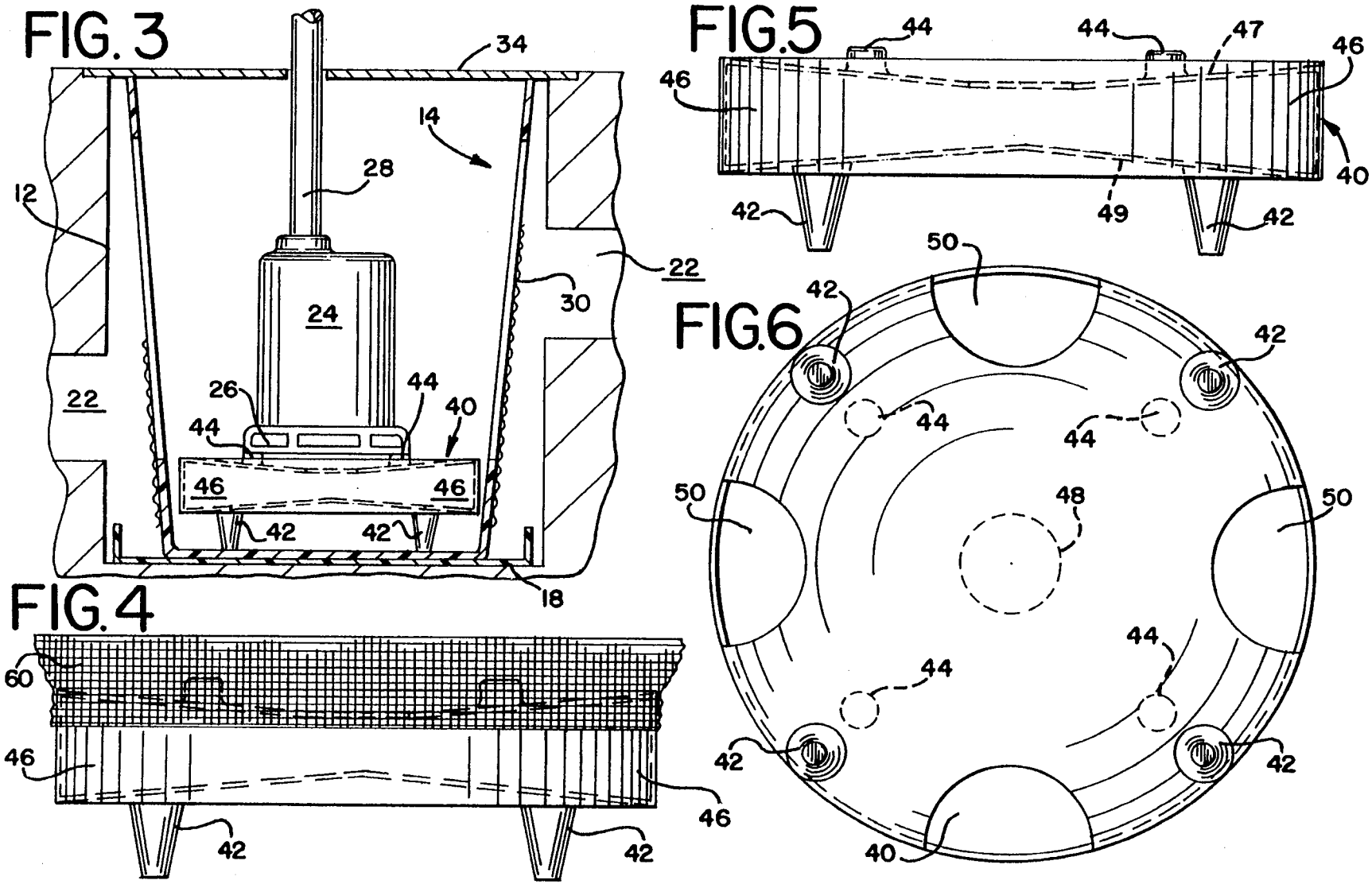
FIG. 3 is a second embodiment in which the sump pump is located on a platform.
FIG. 4 is an embodiment in which the platform is provided with a screen portion to replace the basket in the embodiment shown in FIG. 1.
FIG. 5 is an enlarged view of the platform.
FIG. 6 is a bottom view of the platform shown in FIG. 5.

Referring now to another embodiment illustrated in FIG. 3, there is shown an embodiment in which the pump 24 is located on a platform 40 which supports the pump above the level of the sump pit. The platform 40 is shown in detail in FIG. 5, wherein it contains a plurality of supports 44 on which the pump 24 rests. The platform consists of a downwardly sloped upper wall 47 that includes a central opening 48 located below the level of the pump inlet on which the rocks and other debris accumulate and fall through the hole 48 into the annular chamber 46 formed between the wall 47 and the outwardly sloped lower wall 49. The material in the annular chamber 46 moves outwardly and then falls through the circumferentially spaced openings 50 in the bottom wall 49 of the platform 40 where it will fall to the bottom of the pit. The platform is supported relative to the pit by the legs 42.

Thus, in the embodiment shown in FIG. 3, it can be seen that when the material comes in through the passages 22, normally the screen 30 will filter out a lot of the rocks and debris which will fall to the bottom into the catch tray 18. Rocks and so forth that enter the basket will drop onto the platform 40 and move toward the center thereof, drop through the opening 48 and flow outwardly through the chamber 46 and through the openings 50 into the bottom of the pit.

In the embodiment shown in FIG. 4, the outer basket can be dispensed with and the platform is provided with a screen portion 60 secured to the outer periphery of the platform and extending thereabove. Thus, material will tend to be screened out by the screen 60, but any material entering past the screen will drop down onto the platform 40 through the opening 48 and out the chamber 46 and openings 50 into the bottom of the sump pit.

It is intended to cover by the following claims all embodiments which fall within the true spirit and scope of the invention.

What is claimed is:

1. A sump pump strainer assembly adapted to be positioned in a sump pit comprising a basket disposed in a sump pit for receiving drain water from drain tiles, a sump pump disposed within said basket having an inlet and an outlet, a discharge pipe leading from said outlet to evacuate water from said sump pit, a pump platform disposed in the bottom of said sump pit and including raised supports for said sump pump, said platform having an inwardly sloping upper wall beneath said pump and defining a central opening for receiving debris entering said basket and directing it away from the inlet of said pump, said platform also including a lower outwardly sloping wall for directing the debris received thereby away from the central opening in the upper wall thereof.

2. A sump pump strainer assembly as set forth in claim 1, in which the strainer assembly is disposed in a catch tray and the platform is provided with legs to support it above the bottom of the basket.

3. A platform for supporting a sump pump above the bottom of a sump pit including an inwardly sloping upper wall and an outwardly sloping lower wall, the upper wall is provided with upraised supports for positioning the pump above said upper wall, the upper wall further defining a central opening for receiving and directing debris away from the pump, the lower wall defining circumferentially spaced openings for directing debris deposited on the bottom wall away from the central opening in the top wall, and legs on the bottom of the platform for supporting the platform above the bottom of the sump pit.

4. A platform as set forth in claim 3 in which a screen is secured to the perimeter of the platform and extends thereabove to screen out debris from reaching the inlet of a pump disposed thereon.

* * * * *